US009039129B2

(12) United States Patent
Suzuki et al.

(10) Patent No.: US 9,039,129 B2
(45) Date of Patent: May 26, 2015

(54) INKJET HEAD

(75) Inventors: Isao Suzuki, Shizuoka (JP); Hideaki Nishida, Shizuoka (JP); Shinichiro Hida, Shizuoka (JP); Kazuhisa Kimura, Kanagawa (JP)

(73) Assignee: Toshiba Tec Kabushiki Kaisha, Tokyo (JP)

( * ) Notice: Subject to any disclaimer, the term of this patent is extended or adjusted under 35 U.S.C. 154(b) by 34 days.

(21) Appl. No.: 13/603,550

(22) Filed: Sep. 5, 2012

(65) Prior Publication Data

US 2013/0076838 A1 Mar. 28, 2013

(30) Foreign Application Priority Data

Sep. 26, 2011 (JP) ..... 2011-209070

(51) Int. Cl.
*B41J 2/015* (2006.01)
*B41J 2/14* (2006.01)

(52) U.S. Cl.
CPC .... *B41J 2/14201* (2013.01); *B41J 2002/14362* (2013.01); *B41J 2202/08* (2013.01)

(58) Field of Classification Search
None
See application file for complete search history.

(56) References Cited

U.S. PATENT DOCUMENTS

2006/0187263 A1* 8/2006 Iwao et al. ..... 347/54
2008/0284814 A1* 11/2008 Chikamoto et al. ..... 347/29

FOREIGN PATENT DOCUMENTS

JP 2009-214480 9/2009
JP 2009214480 A * 9/2009

* cited by examiner

*Primary Examiner* — Matthew Luu
*Assistant Examiner* — Erica Lin
(74) *Attorney, Agent, or Firm* — Amin, Turocy & Watson, LLP

(57) ABSTRACT

According to one embodiment, an inkjet head includes a mask part which covers a periphery of an actuator part in a state where a nozzle hole is exposed to outside and a peripheral edge part of which is opposite to an opening peripheral edge part of a frame part at other end while a gap is kept, and the gap between the peripheral edge part of the mask part and the opening peripheral edge part of the frame part at the other end is sealed with a seal agent having thermal insulation properties.

10 Claims, 6 Drawing Sheets

INKJET HEAD

CROSS-REFERENCE TO RELATED APPLICATION

This application is based upon and claims the benefit of priority from Japanese Patent Application No. 2011-209070 filed on Sep. 26, 2011, the entire contents of which are incorporated herein by reference.

FIELD

Embodiments described herein relate generally to an inkjet head which is used in a printer and ejects ink from a nozzle hole to a printing medium.

BACKGROUND

A related art inkjet head is constructed such that a piezoelectric element provided in an ink chamber is driven, and ink in the ink chamber is ejected from a corresponding nozzle hole, and includes a drive IC for driving the piezoelectric element. If the amount of operation of the drive IC increases, the amount of generated heat increases. Thus, the heat is required to be prevented from being conducted to an actuator part including the piezoelectric element and the like, and various structures for that purpose are proposed. Besides, ink supplied into the ink chamber of the actuator part and ejected from the nozzle hole may adhere to a connection part with the piezoelectric element of the actuator part, a wiring board or the like, and structures for preventing the adhesion are also proposed.

In general, the drive IC is attached in a state where the drive IC contacts the inner surface of a side wall of a frame body constituting an outer shell of the inkjet head, and the heat generated in the drive IC is radiated to the outside through the frame body side wall as a heat sink in contact with the drive IC. The actuator part to eject ink from the nozzle hole is provided at an end of the frame, and the periphery of the actuator part is covered with a mask part.

The temperature of the drive IC rises up to about 85° C. when ink is continuously ejected. If the heat is conducted to the actuator part, the viscosity of the ink is changed, or the characteristic of the actuator part is changed, and therefore, the ejection characteristic is changed. Thus, a gap is provided between the heat sink (frame body side wall) for radiating the heat of the drive IC and the mask part covering the actuator part, so that the heat of the heat sink is not conducted to the mask part and the influence of the heat is suppressed. That is, if the gap is not provided, the heat of the drive IC is conducted to the mask part and is conducted to the actuator part, and the influence of the heat is exerted on the actuator part.

However, if the gap exists between the heat sink and the mask part, it is conceivable that ink mist during use intrudes, or ink climbs up along the outer surface of the mask part and intrudes at the time of head maintenance (purge, wipe, etc.). If the ink or the like intrudes through the gap as stated above, the ink adheres to a connection part for transmitting a signal to the actuator part or a printed board, and there arises a problem such as peeling of the connection part or a failure of the board.

According to exemplary embodiments described herein, an inkjet head is provided in which ink does not intrude through a gap between a heat sink and a mask.

DETAILED DESCRIPTION

In general, according to one embodiment, an inkjet head includes a frame part including a side wall used also as a thermal radiation part, an ink supply pipe to supply ink into an inside from an opening of the frame part at one end, an actuator part which is provided at an opening of the frame part at the other end and includes a piezoelectric element to eject ink from a nozzle hole of an ink chamber facing outside in response to an external signal, a drive IC which is in heat transfer contact with an inner surface of the side wall and drives the piezoelectric element, a mask part which covers a periphery of the actuator part in a state where the nozzle hole is exposed to the outside and a peripheral edge part of which is opposite to an opening peripheral edge part of the frame part at the other end while a gap is kept, and a seal agent which seals the gap of the mask part and has thermal insulation properties.

Hereinafter, exemplary embodiments will be described in detail with reference to the drawings.

Basic Structure of Inkjet Head

Figure 7:
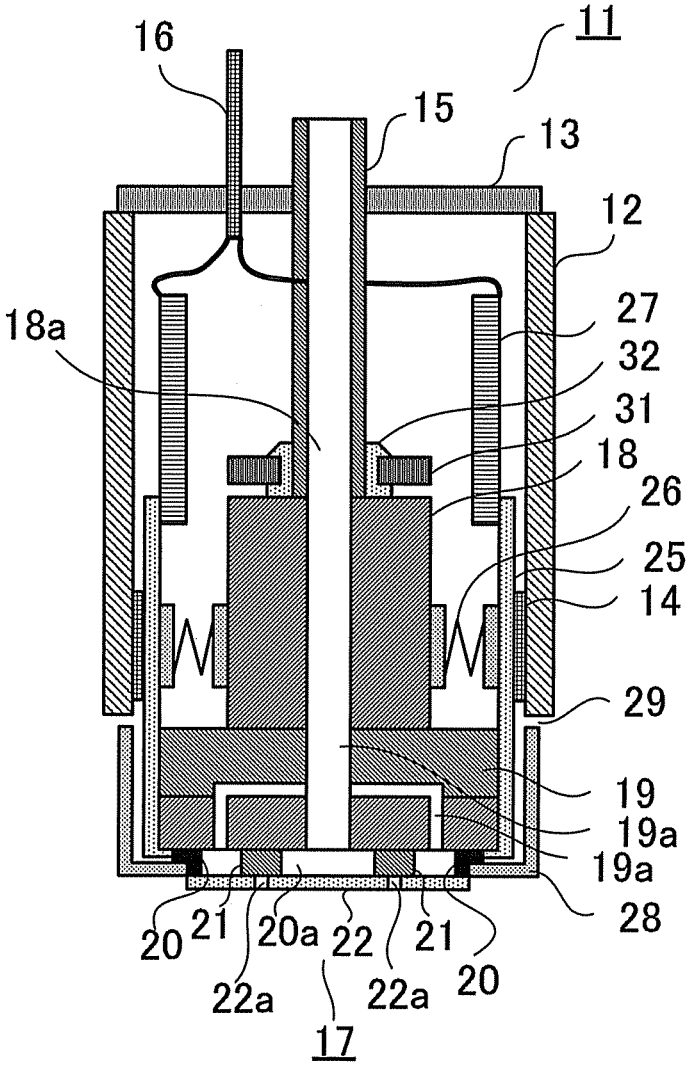
FIG. 7 is a sectional view of an inkjet head as a subject of the embodiments.

First, a basic structure of an inkjet head will be described with reference to FIG. 7. In FIG. 7, an inkjet head 11 includes a frame part 12 formed in a rectangular tube shape, and an opening thereof at one end (illustrated upper end) is closed with a cover 13. A side wall of the frame part 12 is used also as a thermal radiation part (heat sink) of an after-mentioned drive IC 14, and is made of a metal, such as aluminum, having excellent heat conductivity. An ink supply pipe 15 and a connection line 16 to the outside pass through the cover 13 and are held, and are respectively inserted into the inside of the frame part 12.

An actuator part 17 is provided at an opening of the frame part 12 at the other end (illustrated lower end) The actuator part 17 is integrally coupled to a tip (illustrated lower end) portion of the ink supply pipe 15 through a connection member 18, and includes a manifold member 19, an ink chamber 20*a* formed of a frame member 20, piezoelectric elements 21 and a nozzle plate 22.

The manifold member 19 communicates with the ink supply pipe 15 through a passage 18*a* of the connection member 18. The frame member 20 has a rectangular shape when viewed from a lower surface in FIG. 7, and is attached to a lower surface of the manifold member 18. The nozzle plate 22 is bonded to a surface part (illustrated lower surface) of the frame member 20, and the ink chamber 20*a*, one surface of which faces the outside through the nozzle plate 22, is formed inside the frame member 20. The manifold member 19 includes a passage 19*a* for distributing and supplying ink from the ink supply pipe 15 into the ink chamber 20*a*.

Plural nozzle holes 22*a* are formed in the nozzle plate 22. Although the two nozzle holes 22*a* are shown in the example of the drawing, the plural nozzle holes 22*a* are arranged in the depth direction of the paper surface. That is, FIG. 7 shows two nozzle hole lines in each of which the plural nozzle holes 22*a* are arranged in the depth direction of the paper surface.

The piezoelectric elements 21 are provided at positions opposite to the nozzle holes 22*a* in the ink chamber 20*a*, and eject the ink in the ink chamber 20*a* through the nozzle holes 22*a* in response to external signals. The piezoelectric elements 21 are opposite to the two nozzle hole lines in which the plural nozzle holes 22*a* are arranged in the depth direction of the paper surface, and two lines of the piezoelectric elements are provided in the depth direction of the paper surface of FIG. 7. The piezoelectric elements 21 are provided with plural grooves parallel to the paper surface, and when a print signal is received from the outside, the groove portion opposite to the nozzle hole 22*a* is deformed in the width direction, so that the ink in the ink chamber 20*a* is ejected from the nozzle hole 22*a*.

The drive IC 14 functions as a signal conversion part to supply a voltage for operating the piezoelectric element 21, and is mounted on an electronic circuit board (hereinafter referred to as TAB) 25 called TAB (Tape Automated Bonding). The drive IC 14 is in close contact with and in heat transfer contact with the inner surface of the side wall of the frame part 12 as a thermal radiation part through a not-shown heat transfer sheet by a spring member 26 provided between the side surface of the connection member 18 and the TAB.

An illustrated upper end of the TAB 25 is connected to the connection line 16 to the outside through a printed wiring board 27, and transmits an external print signal to the drive IC 14. Besides, an illustrated lower end of the TAB 25 is connected to a not-shown wiring part formed on the lower surface of the manifold member 19, and applies a drive voltage, signal-converted by the drive IC 14, to the piezoelectric element 21 through the wiring part.

The actuator part 17 is provided with a mask part 28 to cover the periphery of the actuator part 17 in a state in which the nozzle hole 22*a* is exposed to the outside. The mask part 28 is bonded to the frame member 20 forming the ink chamber 20*a* as shown in the drawing, and is constructed so as to cover a connection portion to the TAB 25. Since a part of the mask part 28 contacts liquid such as ink, a material excellent in solvent resistance is required, and the mask is made of metal because of easiness of molding. Besides, an illustrated upper peripheral edge part of the mask part 28 is opposite to an illustrated lower peripheral edge part of the frame part 12 while a gap 29 is kept therebetween.

That is, the gap 29 for suppressing the influence of heat is provided between the side wall of the frame part 12 as the heat sink of the drive IC 14 and the mask part 28 to cover the actuator part 17 of the inkjet head. If the gap is not provided, the heat of the drive IC 14 is conducted to the actuator part 17 through the mask part 28. Thus, the viscosity of ink is changed, the characteristic of the actuator is changed, and the ejection characteristic is changed.

However, if the gap 29 exists, as described before, ink mist during use intrudes, or ink climbs up and intrudes at the time of head maintenance (purge, wipe, etc.). The ink adheres to the TAB 25 for transmitting a signal to the actuator part 17 or a connection part thereof, and there arises a problem such as peeling of the connection part or a failure.

Figure 8:
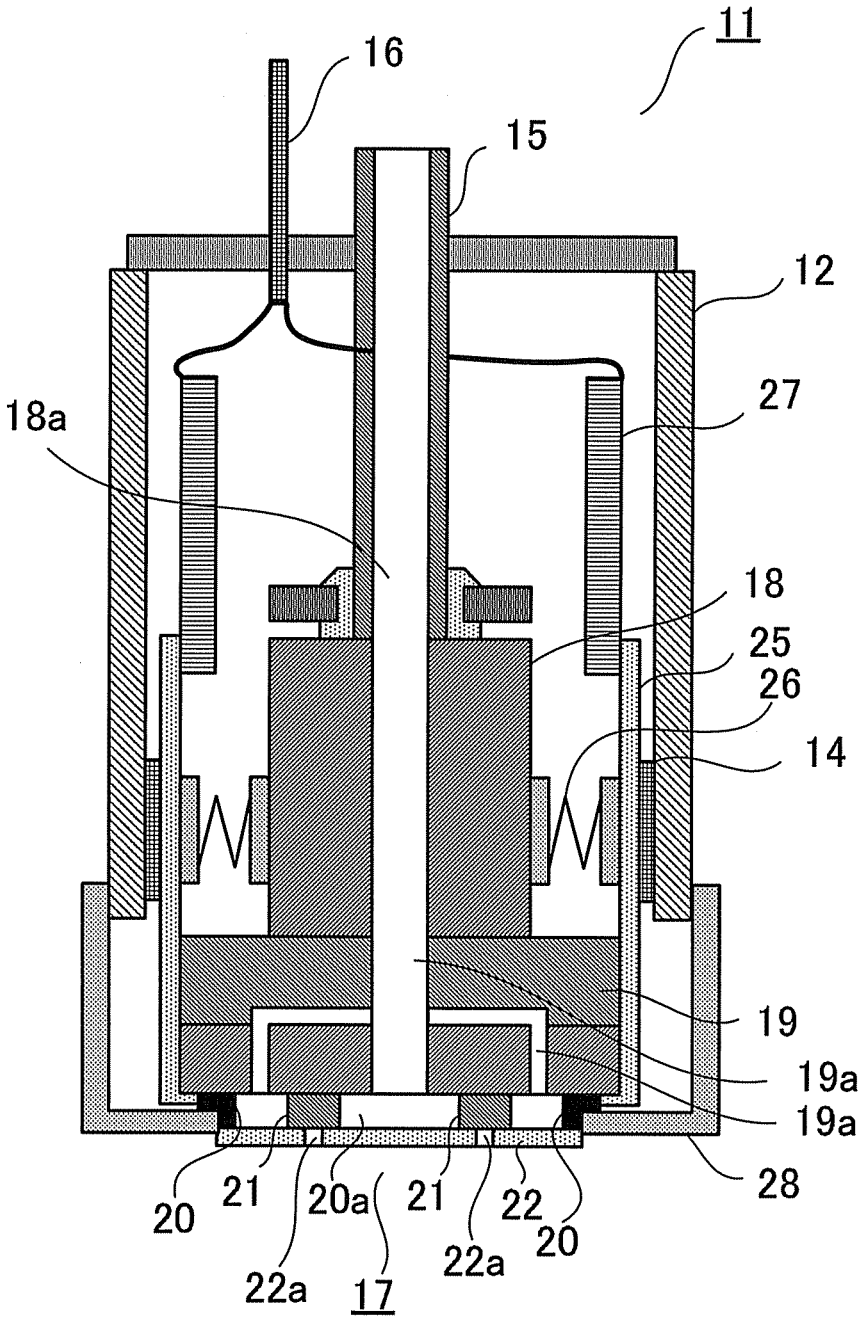
FIG. 8 is a sectional view showing an improvement of the inkjet head shown in FIG. 7.

Thus, as shown in FIG. 8, a structure is conceivable in which a lower end of a side wall of a frame 12 as a thermal radiation part overlaps and is in close contact with an upper edge part of a mask part 28. However, in this structure, although the intrusion risk of ink or the like is reduced, the heat of the thermal radiation part is liable to be conducted to the mask part 28, and the influence is exerted on the ejection characteristic as described before.

Figure 5:
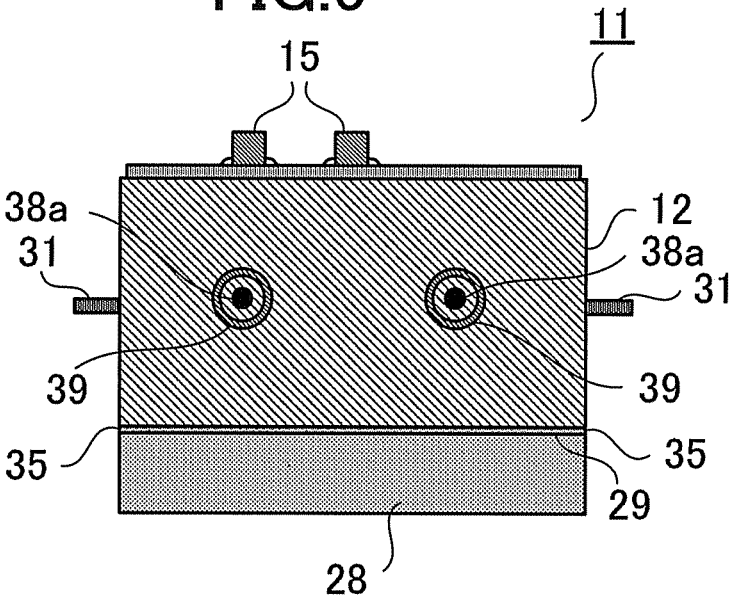
FIG. 5 is a side view of an inkjet head of a fifth embodiment.

Besides, a reference plate 31 extending in a direction perpendicular to the paper surface is integrally provided on an upper part of the connection member 18 by an adhesive 32 in the frame part 12. As shown in FIG. 5, both ends of the reference plate 31 protrude from both end surfaces of the frame part 12, and are used as positioning reference for attaching the inkjet head 11 to a not-shown printer main body. Thus, a distance between the lower surface of the reference plate 31 and the lower surface of the mask part 28 must be accurately controlled.

However, as shown in FIG. 7, if the gap 29 exists between the lower end of the side wall of the frame part 12 and the upper end of the mask part 28, the distance between the lower surface of the reference plate 31 and the lower surface of the mask part 28 is difficult to be kept at an accurate distance. Thus, for example, after the inkjet head 11 is attached to the printer main body, the size adjustment is again required, and the time and labor of assembling work increases.

<First Embodiment>

Figure 1:
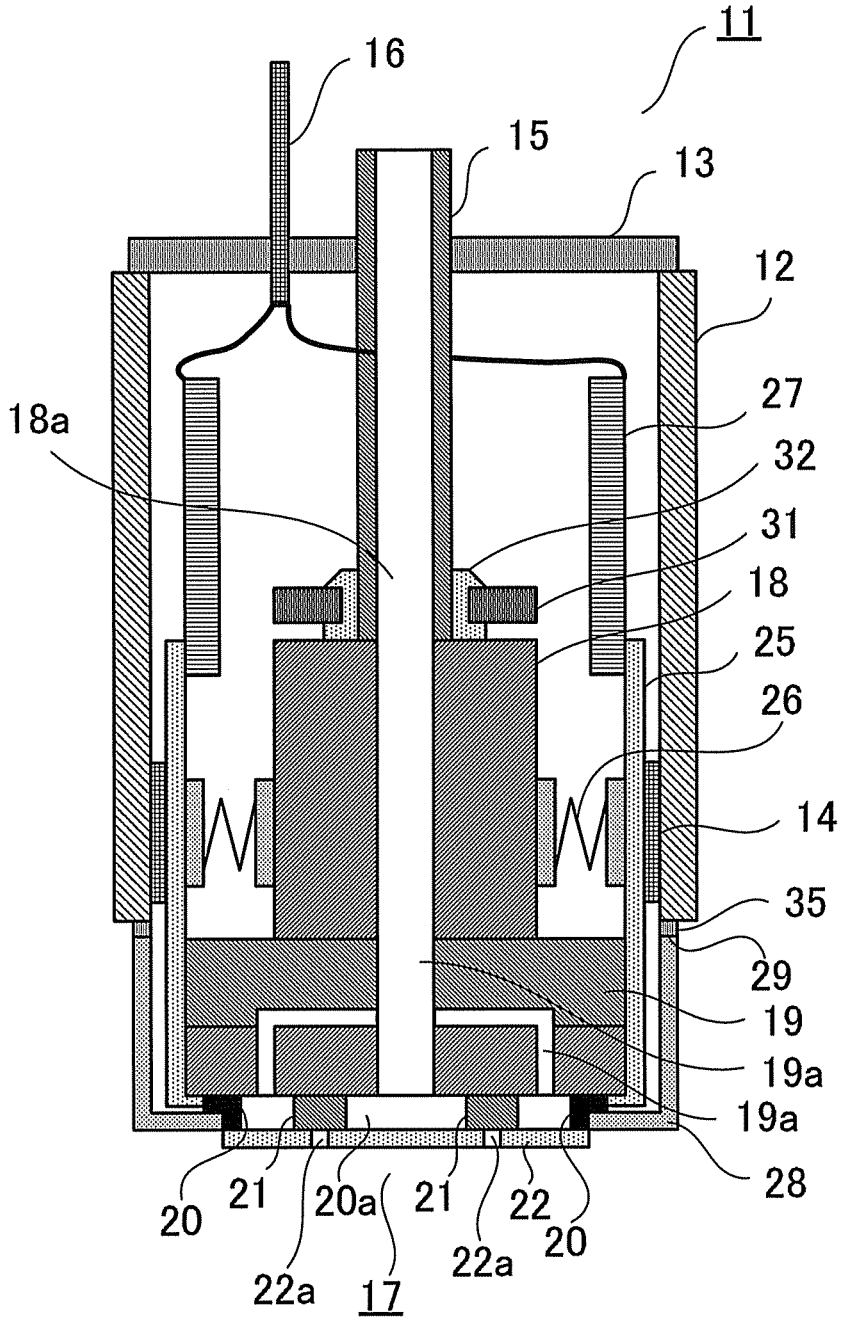
FIG. 1 is a sectional view of an inkjet head of a first embodiment.

According to a first embodiment shown in FIG. 1, the gap 29 between the peripheral edge part (illustrated upper end) of the mask part 28 and the opening peripheral edge part (illustrated lower end) of the frame part 12 at the other end (lower end) is integrally sealed with a seal agent 35 having thermal insulation properties.

As stated above, since the gap 29 between the lower peripheral edge part of the frame part 12 as the heat sink of the drive IC 14 and the upper peripheral edge part of the mask part 28 is integrally sealed with the seal agent 35 having thermal insulation properties, heat conduction therebetween can be suppressed. Thus, it is possible to effectively prevent that heat from the drive IC 14 is conducted to the actuator part 17 through the mask part so that the viscosity of ink is changed, or the characteristic of the actuator part 17 is changed, and the ejection characteristic of ink is changed.

Besides, since the gap 29 is sealed, intrusion of ink mist during use, or intrusion caused by the climbing of ink at the time of head maintenance (purge, wipe, etc.) can be prevented, and the occurrence of a problem, such as adhesion to the TAB 25 for transmitting a signal to the actuator part 17 or the connection part thereof, peeling of the connection part or a failure, can be certainly prevented.

Further, since the gap 29 between the lower end of the side wall of the frame part 12 and the upper end of the mask part 28 is integrally sealed (coupled) with the seal agent 35, the distance between the lower surface of the reference plate 31 and the lower surface of the mask part 28 can be kept at an accurate distance, and the inkjet head 11 can be attached to the printer main body with accurate positional relation.

Since the seal agent 35 has thermal insulation properties, the material is required to have low heat conductivity, and further, since the seal agent is provided at a place where the possibility that the seal agent contacts liquid such as ink is high, the material is required to be excellent in solvent resistance. Thus, for example, a low heat conductive epoxy resin or the like is used. The heat conductivity of the lower heat conductive epoxy resin is about 0.2 W/mK and is sufficiently low as compared with a heat conductivity of 1.6 W/mK of high heat conductive epoxy resin, and the lower heat conductive epoxy resin has the so-called thermal insulation property. From this, as stated above, the heat of the drive IC 14 is made hard to be conducted to the actuator part 17, and the influence on ink ejection can be reduced.

A method of sealing the gap between the lower peripheral edge part of the side wall of the frame part 12 and the upper peripheral edge part of the mask part 28 by the seal agent 35 is performed as follows: First, a liquid thermosetting epoxy resin is applied to a gap part by a dispenser. After application, the epoxy resin is cured in an oven which is set to the curing temperature of the epoxy resin. By performing the sealing in this way, the ink or the like is prevented from adhering to electronic parts inside the head. Besides, heat generated from the drive IC 14 at the time of ink ejection can be made hard to be conducted to the ink chamber, and the inkjet head 11 in which the ejection characteristic is stable can be obtained.

<Second Embodiment>

When ink is continuously ejected, the temperature of the drive IC 14 rises up to about 85° C. At this time, when the inkjet head 11 is in a completely hermetically sealed state relative to the outside, the inner pressure rises by the temperature rise of the drive IC 14, and breakage at the sealing part of the seal agent 35 may occur. Besides, when resin is applied and cured in a manufacturing process, heating is sometimes performed up to about 120° C. Thus, also in the manufacturing process, consideration must be paid to the variation of inner pressure due to the temperature change.

That is, in the inkjet head (sometimes hereinafter simply referred to as the head) 11, when the inside of the head 11 generates heat by the heat generation of the drive IC 14 or the like, the pressure rises by expansion of the inner air. If consideration is paid also to transportation by air plane, the temperature can change from −10° C. to 85° C. (upper limit in continuous use). In the temperature change as stated above, a pressure variation by a factor of about 1.4 can occur. In the case of the highest temperature of 120° C. in the manufacturing process, a variation by a factor of 1.55 occurs (from Boyle Charles law of $P=kT/V$)

Then, a pressure releasing part for releasing pressure in the unit of the inkjet head 11 including a heat generating source such as the drive IC 14 to the outside is provided. The pressure releasing part may be provided at any place as long as the outside of the head 11 can be made to communicate with the inside. However, when consideration is paid to a fact that ink or the like drops at the time of attachment or detachment of an ink supply system to or from the head 11, the pressure releasing part is preferably provided on a side surface other than the upper part of the head 11.

Figure 2:
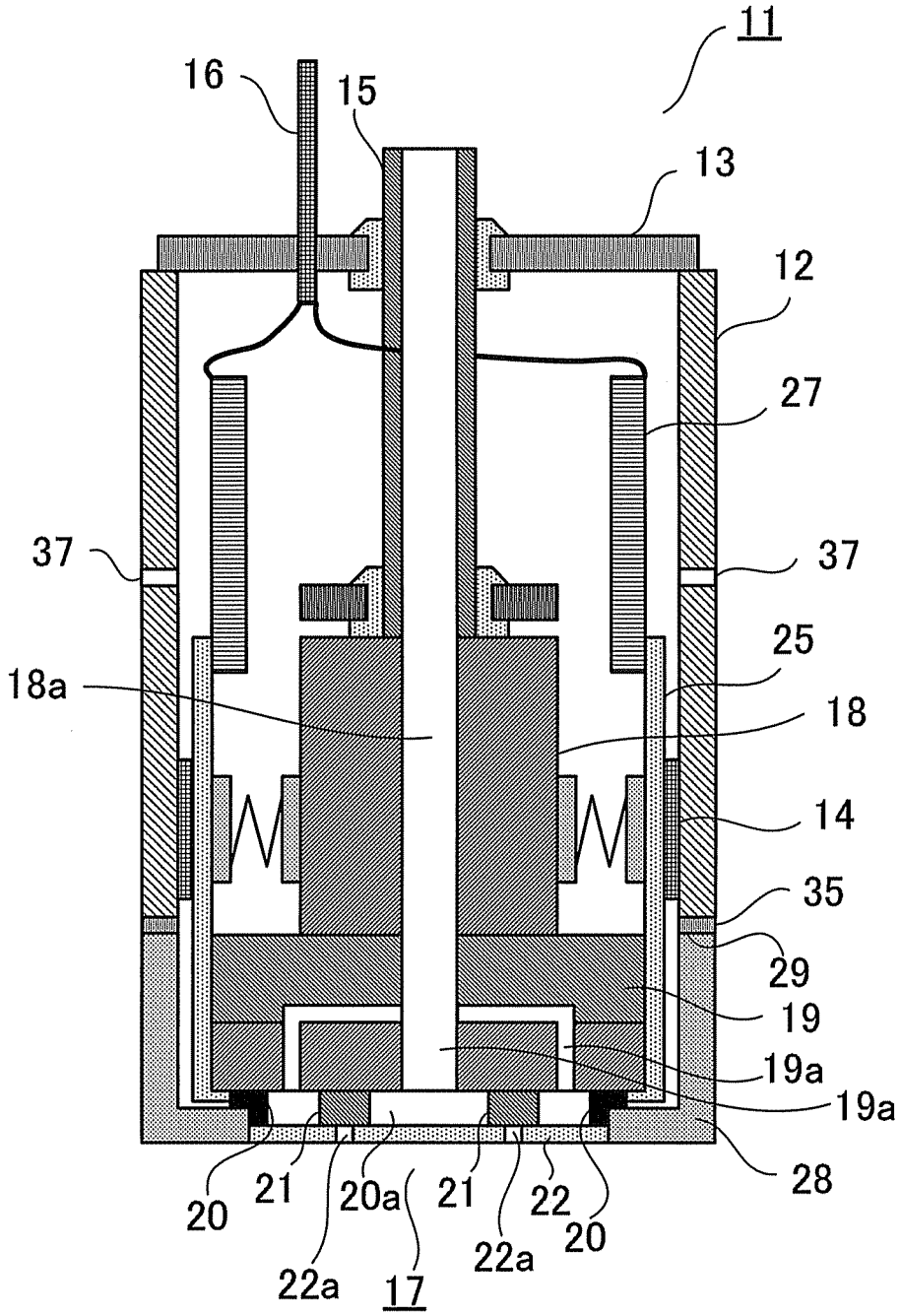
FIG. 2 is a sectional view of an inkjet head of a second embodiment.

In a second embodiment shown in FIG. 2, a small hole 37 is formed as a pressure releasing part in the side wall of the frame part 12. The small hole 37 is preferably as small as possible. If large, ink liquid or the like easily intrudes from the outside of the head 11, and the head 11 may go wrong. Accordingly, the diameter is made 1 mm or less, and the diameter may be, for example, about 0.5 mm. By adopting the structure as stated above, even if the pressure variation due to the temperature change in the head 11 occurs, the inner pressure can be released, and the trouble of the head 11, such as breakage of the sealing part, can be prevented.

<Third Embodiment>

Figure 3:
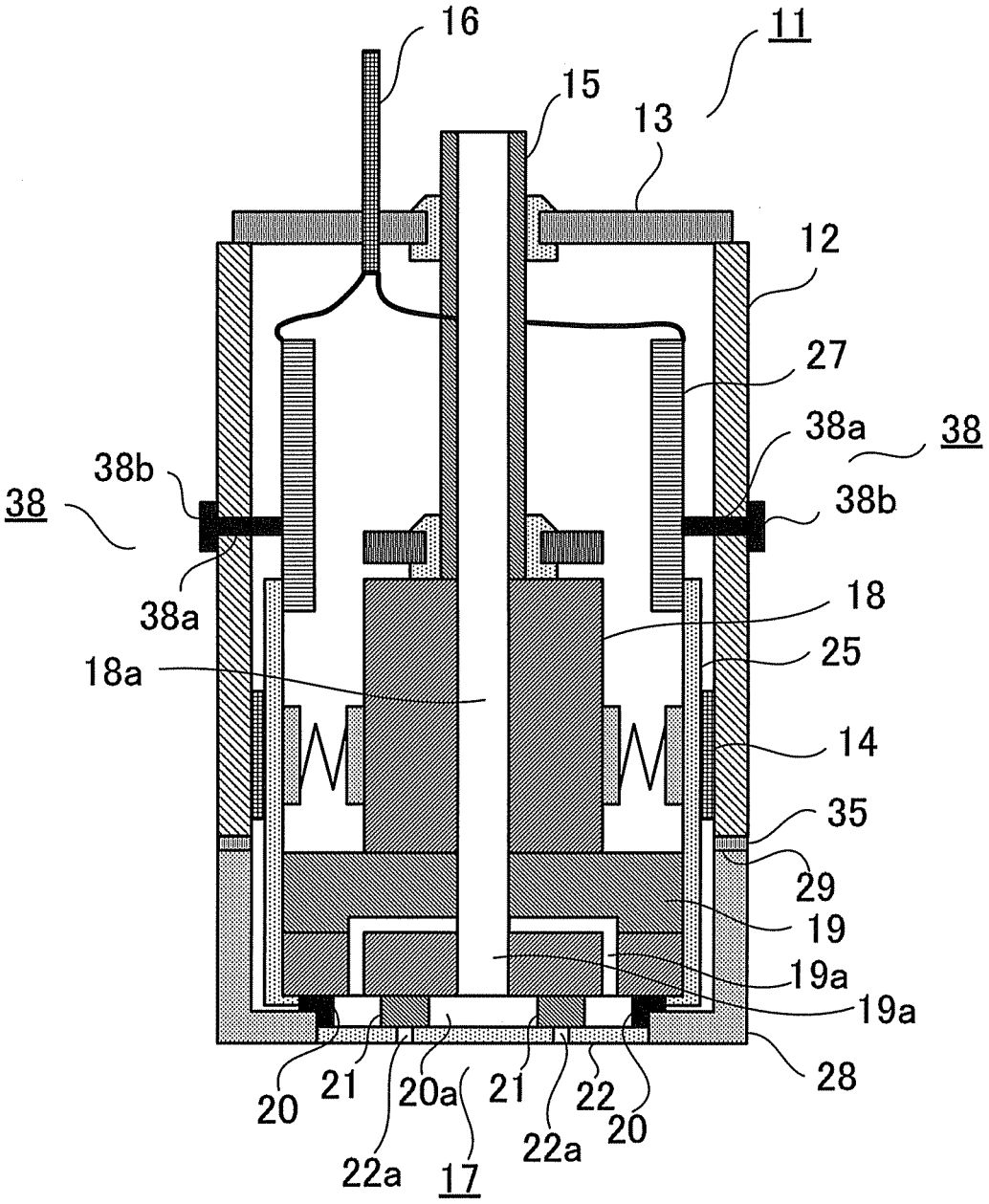
FIG. 3 is a sectional view of an inkjet head of a third embodiment.

In a third embodiment shown in FIG. 3, a pressure releasing part is a screw unit 38. That is, the screw unit is constructed of a screw hole 38*a* provided in the side wall of the frame part 12 and a screw 38*b* threaded in the screw hole 38*a*. In the screw unit 38, pressure adjustment (pressure release to the outside) can be performed by a screw gap, and the intrusion of ink or the like can be prevented. Besides, since the intrusion of ink is prevented by providing the screw unit 38, the screw hole 38*a* itself may be large, and can be used also in a pressure test described later.

<Fourth Embodiment>

Figure 4:
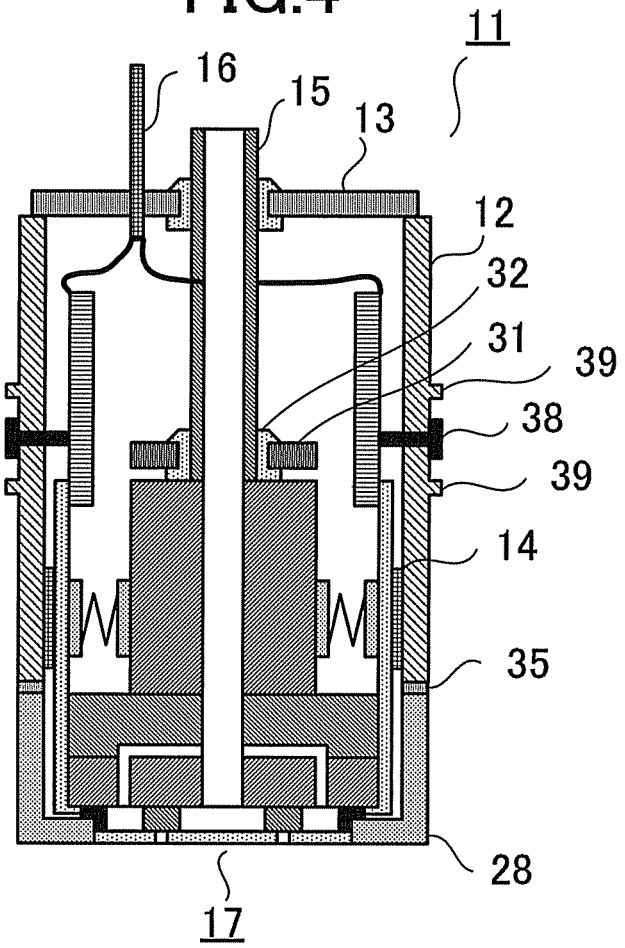
FIG. 4 is a sectional view of an inkjet head of a fourth embodiment.

In an embodiment shown in FIG. 4, a bank-shaped wall 39 is provided around a pressure releasing part of a screw unit 38. A pressure releasing part of a small hole 37 having a diameter of about 1 mm or less may be formed instead of the screw unit 38.

The wall 39 is provided at an upper part of the screw unit 38, which is supposed to be an intrusion passage of ink dropping at the time of attachment or detachment of an ink supply system to or from the head 11 or at a lower part of the screw unit 38, which is supposed to be an intrusion passage of ink climbing up at the time of head maintenance (purge, wipe, etc.). As stated above, the bank-shaped wall 39 is provided at the place which is supposed to be the intrusion passage of ink, so that the intrusion risk of ink into the head 11 can be reduced.

<Fifth Embodiment>

Besides, as shown in FIG. 5, the bank-shaped wall 39 may be formed in an annular shape so as to surround the pressure releasing part of the screw unit 38. If the wall is formed in the annular shape as stated above, the intrusion risk of ink into the head 11 can be further reduced.

Further, a top part of the bank-shaped wall 39 formed in the annular shape is preferably made flush, that is, formed to have uniform height. By adopting the structure as stated above, the screw hole 38*a* surrounded by the bank-shaped wall 39 formed in the annular shape can be used also for the pressure test. That is, the top part is made flush, so that the screw hole 38*a* surrounded by the annular bank-shaped wall 39 can be used as a check hole for checking a sealing state of the head 11.

The check is performed by inspecting a state when an inner pressure is changed in a hermetically sealed state in which rubber or the like is pressed to the top part of the annular bank-shaped wall 39. If the top part is flush, leakage hardly occurs when the rubber or the like is pressed, and this is suitable for the pressure test.

Figure 6:
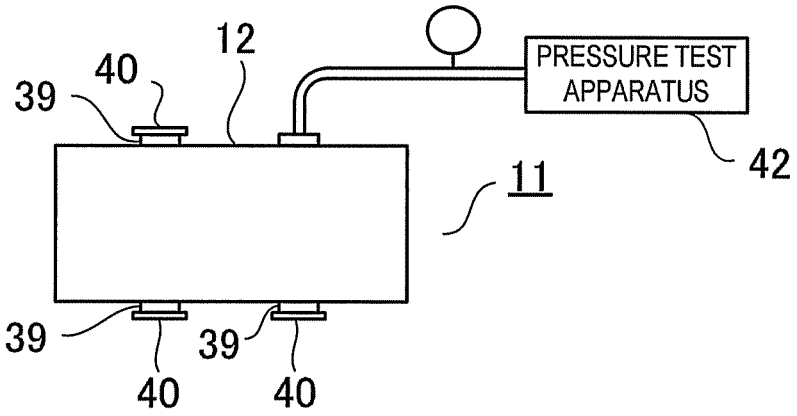
FIG. 6 is a conceptual view showing a pressure test state of the inkjet head shown in FIG. 5.

In the pressure test, specifically, first, the screws 38*b* of the plural screw units 38 are detached from the screw holes 38*a*, and the screw units 38 are opened. As shown in FIG. 6, rubber plate bodies 40 are pressed to the top parts of the annular bank-shaped walls 39 around the screw units 38 except for one specific screw unit 38 among the plural opened screw units 38, and the screw units 38 are hermetically sealed.

In this state, a pressure test apparatus 42 having a pressurizing and depressurizing function is coupled to the screw hole 38*a* of the one specific screw unit 38 which is not sealed. The air in the head 11 is depressurized or pressurized by the pressure test apparatus 42, and leak check or the like of the head 11 can be easily performed.

<Effects, Modified Examples, Applied Examples>

According to the embodiments, the inkjet head in which ink does not intrude through the gap between the heat sink and the mask is obtained.

In the embodiment, also when the small hole having a diameter of about 1 mm or less is provided, the bank-shaped wall may be provided similarly to the fifth embodiment, and further, the top part thereof may be made flush.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as fall within the scope and spirit of the inventions.

What is claimed is:

1. An inkjet head comprising: a frame part, made of metal, including a side wall used also as a thermal radiation part; an ink supply pipe to supply ink into an inside from an opening of the frame part at one end; an actuator part which is provided at an opening of the frame part at the other end and includes a piezoelectric element to eject ink from a nozzle hole of an ink chamber facing outside in response to an external signal; a drive IC directly contacting an inner surface of the side wall of the frame part, said drive IC for driving the piezoelectric element; a mask part, made of metal. which covers a periphery of the actuator part in a state where the nozzle hole is exposed to the outside and a peripheral edge part of which is opposite to an opening peripheral edge part of the frame part at the other end while a gap is kept therebetween; and a seal agent which directly seals the gap between the mask part and the part and has thermal insulation properties.

2. The inkjet head of claim 1, wherein a pressure releasing part capable of releasing inner pressure to outside atmosphere is provided in the side wall of the frame part.

3. The inkjet head of claim 2, wherein the pressure releasing part is a screw unit including a screw hole and a screw threaded in the screw hole.

4. The inkjet head of claim 3, wherein a protuberant wall is provided around the pressure releasing part.

5. The inkjet head of claim 4, wherein the protuberant wall has an annular shape to surround the pressure releasing part.

6. The inkjet head of claim 5, wherein a top part of the protuberant wall has a uniform height.

7. The inkjet head of claim 2, wherein the pressure releasing part is a hole having a diameter of 1 mm or less.

8. The inkjet head of claim 7, wherein a protuberant wall is provided around the pressure releasing part.

9. The inkjet head of claim 8, wherein the protuberant wall has an annular shape to surround the pressure releasing part.

10. The inkjet head of claim 9, wherein a top part of the protuberant wall has a uniform height.

* * * * *